US009879460B2

(12) United States Patent
Nilsson

(10) Patent No.: US 9,879,460 B2
(45) Date of Patent: Jan. 30, 2018

(54) SLIDING DOOR ARRANGEMENT

(71) Applicant: Elfa International AB, Västervik (SE)

(72) Inventor: Peter Nilsson, Västervik (SE)

(73) Assignee: Elfa International AB, Vastervik (SE)

( * ) Notice: Subject to any disclaimer, the term of this patent is extended or adjusted under 35 U.S.C. 154(b) by 0 days.

(21) Appl. No.: 14/784,870

(22) PCT Filed: Apr. 7, 2014

(86) PCT No.: PCT/EP2014/056894
§ 371 (c)(1),
(2) Date: Oct. 15, 2015

(87) PCT Pub. No.: WO2014/170151
PCT Pub. Date: Oct. 23, 2014

(65) Prior Publication Data

US 2016/0060936 A1 Mar. 3, 2016

(30) Foreign Application Priority Data

Apr. 16, 2013 (EP) ..... 13163929

(51) Int. Cl.
*E05F 11/00* (2006.01)
*E05F 5/00* (2017.01)
(Continued)

(52) U.S. Cl.
CPC ..... *E05F 5/003* (2013.01); *E05D 15/0626* (2013.01); *E05D 15/0643* (2013.01);
(Continued)

(58) Field of Classification Search
CPC ..... E05D 15/0643; E05D 15/0678; E05D 15/0626; E05D 15/0634; E05D 15/0669;
(Continued)

(56) References Cited

U.S. PATENT DOCUMENTS 1,489,734 A * 4/1924 Brasch ..... E05D 15/0626 16/104
3,022,537 A * 2/1962 Blackmer ..... E05D 15/0634 16/105

(Continued)

FOREIGN PATENT DOCUMENTS

EP 2372064 A1 4/2010
EP 2372066 A1 4/2010
JP 2005290769 A 10/2005

OTHER PUBLICATIONS

European Patent Office, International Search Report, International Application PCT/EP2014/056894 filed under the Patent Cooperation Treaty, Oct. 23, 2014.

(Continued)

*Primary Examiner* — Katherine Mitchell
*Assistant Examiner* — Abe Massad
(74) *Attorney, Agent, or Firm* — Hubbard Johnston, PLLC

(57) ABSTRACT

A sliding door arrangement with a sliding door, a rail guiding a sliding motion of the door, and an attenuation and retraction device. The attenuation and retraction device includes a lid with a slot that is open towards the rail. The door includes a pin having an end adapted to enter the slot for interacting with attenuation and retraction device when the pin reaches an entry point of the attenuation and retraction device. The lid includes ramp portion adapted to interact with the pin such that the pin reaches further into the slot after passing the entry point as the door approaches an end position.

11 Claims, 6 Drawing Sheets

(51) Int. Cl.

| | |
|---|---|
| ***E05F 1/16*** | (2006.01) |
| ***E05D 15/06*** | (2006.01) |
| ***E06B 3/46*** | (2006.01) |
| *E05F 5/02* | (2006.01) |

(52) U.S. Cl.
CPC ..... *E05F 1/16* (2013.01); *E06B 3/4636* (2013.01); *E05F 5/027* (2013.01); *E05Y 2201/412* (2013.01); *E05Y 2201/47* (2013.01); *E05Y 2201/688* (2013.01); *E05Y 2800/23* (2013.01); *E05Y 2800/24* (2013.01)

(58) Field of Classification Search
CPC . E05F 1/16; E05F 5/003; E05F 3/4636; E05F 5/027; E05Y 2201/412
See application file for complete search history.

(56) References Cited

U.S. PATENT DOCUMENTS

| | | | | |
|---|---|---|---|---|
| 4,006,513 | A * | 2/1977 | Offterdinger | E05D 15/0669 16/105 |
| 4,404,771 | A * | 9/1983 | Murase | E05D 15/0669 16/105 |
| 5,671,502 | A | 9/1997 | Ezman | |
| 5,673,516 | A | 10/1997 | Hughes et al. | |
| 5,860,264 | A | 1/1999 | Gephart et al. | |
| 5,927,017 | A | 7/1999 | Jacobs et al. | |
| 5,964,061 | A | 10/1999 | Hughes et al. | |
| 6,209,171 | B1 | 4/2001 | Pelletier et al. | |
| 6,324,727 | B1 | 12/2001 | Ortoleva et al. | |
| 6,449,906 | B1 | 9/2002 | Jacobs | |
| 6,516,575 | B2 * | 2/2003 | Haab | E05D 13/04 160/196.1 |
| 7,293,389 | B2 | 11/2007 | Jacobs | |
| 7,350,332 | B2 | 4/2008 | Petridis et al. | |
| 7,520,090 | B2 | 4/2009 | Gerhart | |
| 7,533,502 | B2 | 5/2009 | Siegel | |
| 7,647,729 | B2 | 1/2010 | Polus | |
| 7,762,020 | B2 | 7/2010 | Petridis et al. | |
| 7,866,003 | B2 * | 1/2011 | Tooyama | E05F 5/003 16/422 |
| 7,886,403 | B2 * | 2/2011 | Nezu | E05B 65/0858 16/87 R |
| 8,282,177 | B1 * | 10/2012 | Rotter | A47B 88/047 312/319.1 |
| 2004/0159048 | A1 | 8/2004 | Jacobs | |
| 2004/0183411 | A1 * | 9/2004 | Boks | A47B 88/047 312/333 |
| 2005/0000164 | A1 | 1/2005 | Jacobs | |
| 2006/0016144 | A1 | 1/2006 | Jacobs | |
| 2008/0134583 | A1 | 6/2008 | Polus | |
| 2009/0293366 | A1 | 12/2009 | Wefer | |
| 2010/0175327 | A1 | 7/2010 | Busch et al. | |
| 2010/0175328 | A1 | 7/2010 | Hess | |
| 2011/0041284 | A1 * | 2/2011 | Kimura | A47B 88/047 16/49 |
| 2013/0014343 | A1 * | 1/2013 | Tanno | A47B 88/047 16/49 |
| 2013/0042534 | A1 | 2/2013 | Polus | |
| 2013/0199099 | A1 * | 8/2013 | Ryden | E05F 1/16 49/449 |

OTHER PUBLICATIONS

First Examination Report issued by New Zealand Intellectual Property Office received in corresponding New Zealand Application No. 712899, dated Sep. 14, 2017, 3 pages.

* cited by examiner

SLIDING DOOR ARRANGEMENT

CROSS-REFERENCE TO RELATED APPLICATION

The present application is a nationalization under 35 U.S.C. §371 of International Application No. PCT/EP2014/056894 filed under the PCT, having an international filing date of Apr. 7, 2014, which claims priority to European Patent Application No. EP 13163929.6, having a filing date of Apr. 16, 2013.

FIELD OF INVENTION

The present disclosure relates to a sliding door arrangement with a sliding door, a rail system, comprising a first rail which guides a sliding motion of the door, and an attenuation and retraction device, which brakes the sliding motion of the door at a brake position in the vicinity of a door end position and retracts the door to the end position. The attenuation and retraction device is placed in the extension of the first rail and comprises a lid with a slot that is open, at an entry point, towards the first rail, and the door comprises a pin, a first end of which is slideably attached to the door, and a second end of which is devised to enter the slot to interact with the attenuation and retraction device when reaching the entry point.

BACKGROUND OF INVENTION

Such an arrangement is disclosed in EP-2372064-A1, where a pin is urged against the rail by means of a spring. Alternatively, if the rail is placed under the door, the pin's own weight may be used to apply a sufficient pressure against the rail to ensure that the pin reliably snaps into the attenuation and retraction device slot.

A problem associated with sliding door arrangements of this kind is how to improve their operation while maintaining reliability.

SUMMARY OF INVENTION

An object of the present disclosure is therefore to improve the operation of an arrangement of the initially mentioned kind with maintained reliability. More specifically, in an arrangement of the initially mentioned kind, the attenuation and retraction device comprises a catching device which is arranged to interact with the pin, such that the pin reaches further into the slot after passing the entry point as the door approaches the end position. Thanks to this arrangement, the pin does not have to be urged against the rail, and still may be connected with the attenuation and retraction device in a reliable way when the braking position is reached. The pin does therefore not have to wear against the rail, which increases the life of the arrangement as a whole. Further, less friction and noise is produced when the pin does not have to be urged against the rail.

The catching device may be provided in the form of a ramp device in the lid slot. Then, the slot may have longitudinal edges and the ramp device may comprise a portion of the longitudinal edges that rise gradually further from the top surface of the lid, in the direction towards the rail, until reaching a tip of the edge in the vicinity of the entry point.

The pin may have a tip, intended to interact with the attenuation and retraction device, a wing portion, which is wider than the width of the slot in the attenuation and retraction device, and a waist portion, on the other side of the wing portion as seen from the tip, which is narrower than the width of the slot in the attenuation and retraction device, such that the wing portion can enter beneath the slot edges after passing the entry point towards the end position.

To further facilitate the interaction between the pin and the attenuation and retraction device, the wing portion may have a tapering part, tapering towards the attenuation and retraction device.

A spring may be used to urge the pin towards the retracted position.

The door may further comprise a wheel carried by a wheel holder, which is arranged to move the wheel between a retracted position and an extended position, and a transmission mechanism which interconnects the wheel holder and the pin such that a movement of the wheel, towards the extended position of the wheel, urges the pin towards the extended position. This steers the pin in such a way that it is reliably presented to the catching function of the attenuation and retraction device.

The wheel holder may be devised to urge the wheel, towards its extended position, against the rail, by means of a spring.

The transmission mechanism may be arranged to maintain a gap between the tip of the pin and the rail, e.g. in the range 2±0.5 mm.

The wheel holder and the pin may be mounted in a cassette.

BRIEF DESCRIPTION OF DRAWINGS

For a more complete understanding of the present invention, and the advantages thereof, reference is now made to the following descriptions taken in conjunction with the accompanying drawings, in which.

DETAILED DESCRIPTION OF THE INVENTION

The principles of the present invention and their advantages are best understood by referring to the illustrated embodiment depicted in FIGS. 1-14 of the drawings, in which like numbers designate like parts.

The present disclosure relates generally to a sliding door arrangement. Such an arrangement is typically used to delimit a niche or recess, which may be provided with shelves and may be used as a closet. Another use for a sliding door arrangement is as a room dividing device providing a semi-removable wall. Needless to say, there are other uses.

Figure 1:
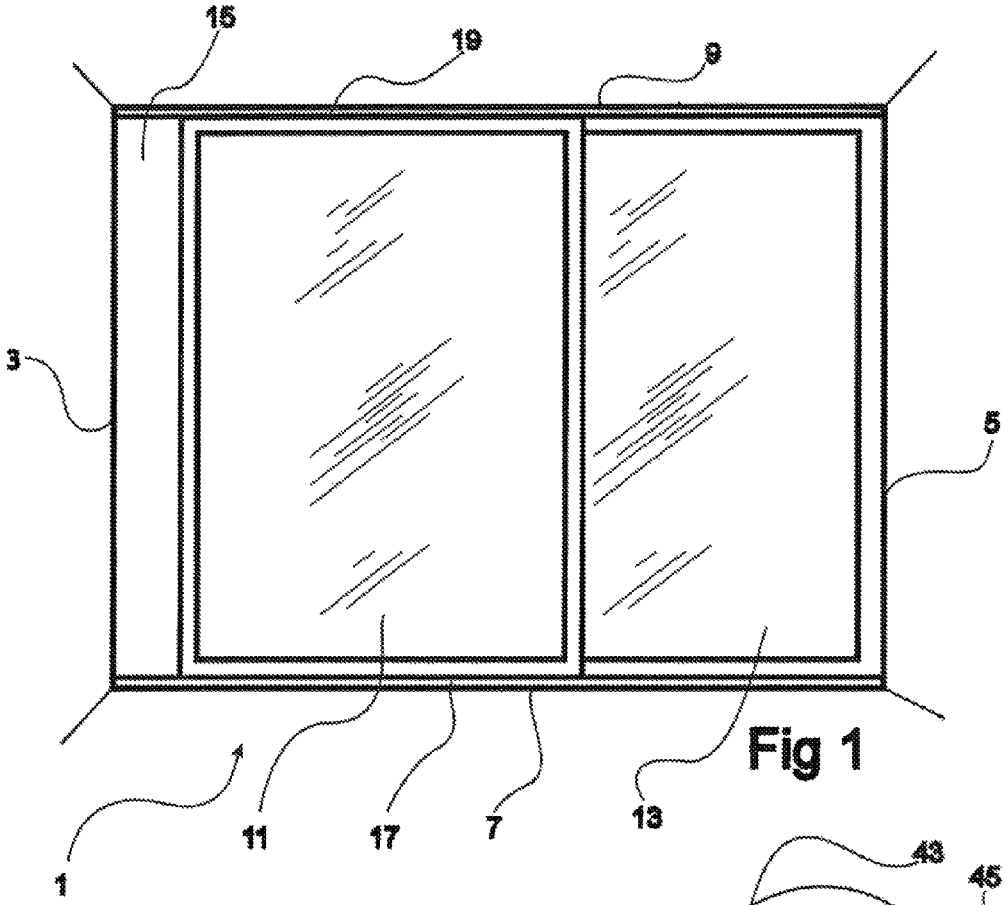
FIG. 1 shows a sliding door arrangement.

FIG. 1 illustrates schematically a sliding door arrangement 1. Typically, the door arrangement may be used at the end of a room, extending between a first wall 3 and a second wall 5, and between the floor 7 and the ceiling 9. In the illustrated case, only two doors 11, 13 are used, although the number of doors may even exceed five in some applications. The space 15 behind the doors may be provided with shelves and may be used as a closet. When the doors are closed, the space 15 behind the doors is both concealed and protected from dust and the like. The doors may provide mirror panels or decorative panels of different kinds. Usually, the total width of the doors exceeds that of the opening such that the doors overlap each other avoiding any gaps between the doors in their closed position.

The sliding doors 11, 13 are mounted between a bottom rail 17 and a top rail 19. As will be shown later, each door may have two top wheels that are resiliently urged towards a track of the top rail 19 and two bottom wheels that rest on a track of the bottom rail 17. In the illustrated case, the arrangement is fitted between the ceiling and the floor of a room. As will be shown, the wheels are kept in place by wheel holders that are capable of moving the wheels between a more retracted position and a more extended position. The arrangement may also be used, for example, in an opening between two rooms, in which case the top rail 19 may instead be fitted under the top piece of the opening. A further possibility is to attach the top rail to the wall above such an opening.

A sliding door arrangement of this kind may be built in a room from the outset, or may be added later on. Particularly in the latter case, the arrangement may need be adjustable to some extent in order compensate for being used in a not perfectly rectangular opening. For instance, if the second wall 5 is slightly inclined, i.e. deviating slightly from the vertical, the second door 13 may be inclined too, such that its right edge runs parallel with the second wall, thereby avoiding any gap between the second door 13 and the second wall 5 at the rightmost position of the former. This can be done by adjusting either or both of the door's bottom wheels.

Figure 3:
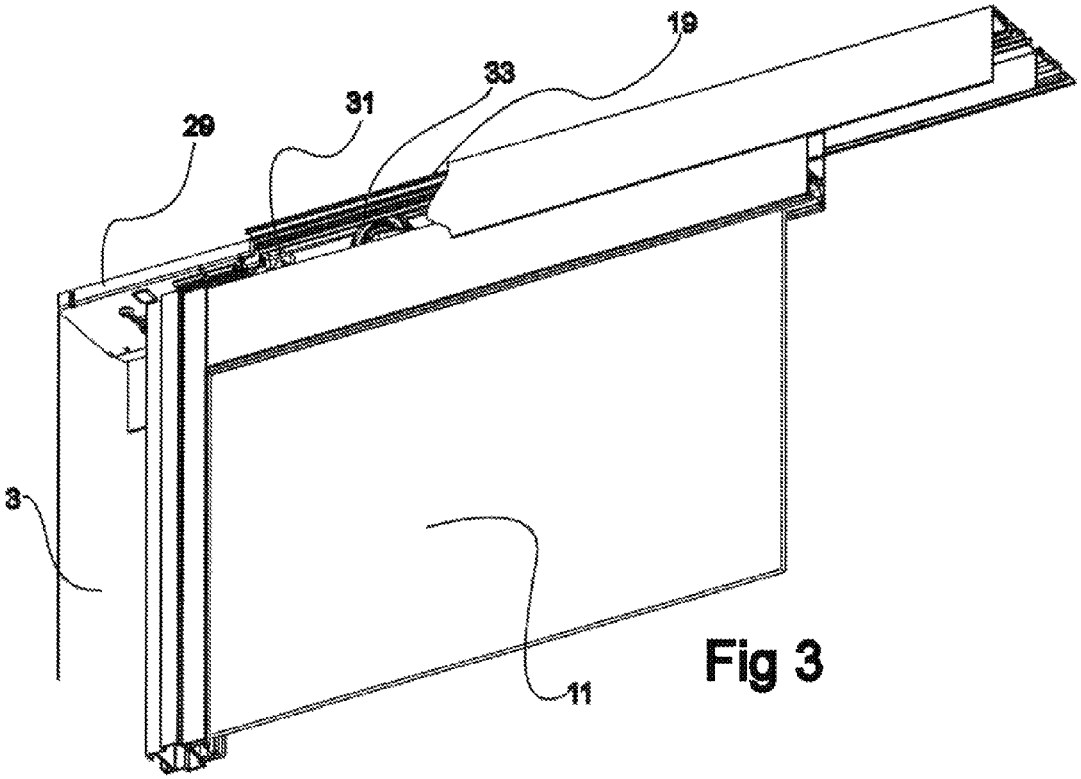
FIG. 3 shows a part of a door guided by a rail.

FIG. 3 illustrates a part of a sliding door arrangement according to the present disclosure. The door arrangement is provided with at least one attenuation and retraction device 29. This device is used to provide smooth, silent and accurate operation of the door. The attenuation and retraction device is active in the vicinity of an end position of the door 11, i.e. where the door reaches the left wall 3. When the door 11 approaches this end position it reaches a brake position at which point a pin 31 of the door interacts with the attenuation and retraction device which begins to absorb the kinetic energy of the door 11. The pin 31 is slideably attached to the door and is moveable towards the rail between a retracted position and an extended position. At the same time as the kinetic energy is absorbed, the attenuation and retraction device pulls in the door 11 to the end position where the left edge of the door is in contact with or in close proximity to the left wall 3. This feature results in the door being completely shut thanks to the retraction function. At the same time, door 11 is prevented from slamming into the wall 3 thanks to the attenuating/braking function. It should be noted that a door of this type may typically weigh up to 30 kg or even more. Attenuation and retraction devices providing a soft-closing function are, as mentioned, per se well known in many applications such as drawers and the like.

The upper left wheel 33 of the door 11 need not be placed at the side edge of the door, which means that the rail 19 which guides the door 11 need not extend all the way to the wall 3. Thereby, the attenuation and retraction device 29 can be placed in the elongation of the rail 19. The attenuation and retraction device 29 interacts with the tip of the pin 31, braking the door and closing the door as is well known per se. An example of the operation of an attenuation and retraction device is shown in EP-2372064-A1 and EP-2372066-A1. It has been suggested to urge the pin 31 against the rail 19 to ensure that the pin snaps into the slot of the attenuation and retraction device.

In the present disclosure, the attenuation and retraction device is instead devised with a catching function that positions the tip of the pin 31 in the attenuation and retraction device 29 in such a way that proper interaction is ensured.

Figure 2B:
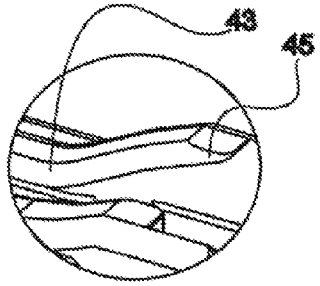
FIG. 2*b* shows an enlarged portion of the lid of FIG. 2*a;*
Figure 2A:
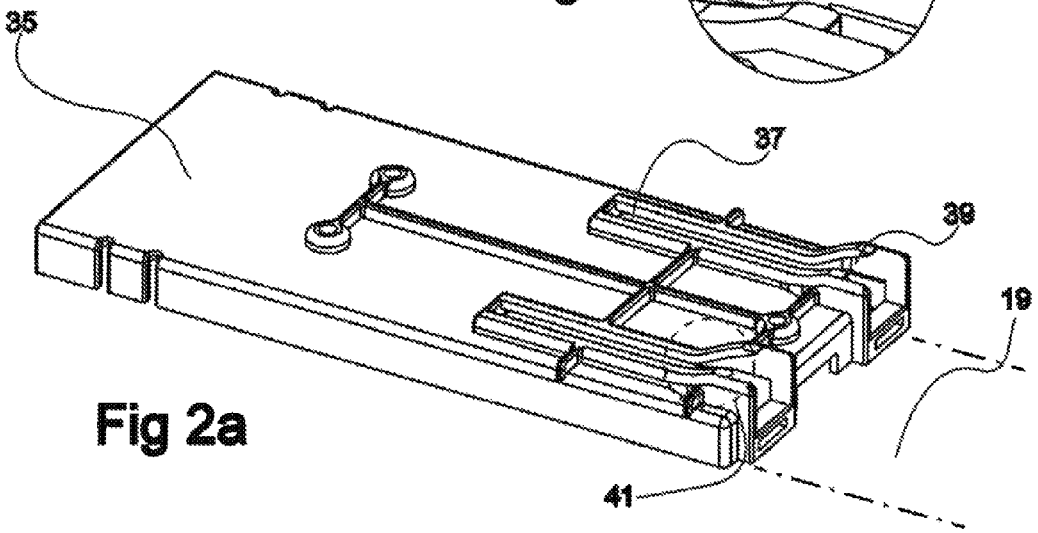
FIG. 2*a* shows a perspective view of a lid of an attenuation and retraction device.

The lid 35 of the attenuation and retraction device is shown in FIG. 2*a*. The lid comprises at least one slot 37; in the illustrated case, the lid has two slots. The attenuation and retraction device is intended to be placed in the extension of the rail 19 (position indicated) and the slot 37 is open, at an entry point 39, towards the rail.

In order to accomplish the catching function, the lid 35 comprises a catching device in the form of a ramp portion 41 which is arranged to interact with the pin 31. In the ramp portion 41, which is shown enlarged in FIG. 2*b*, the longitudinal edges 43 of the slot 37 rise towards the door further from the top surface of the lid 35, in the direction towards the rail 19, until, at a tip 45 of the edge 43 at the entry point 39, the distance to the base of the attenuation and retraction device (and typically to the roof (ceiling 9 of FIG. 1) if the device is top mounted) is at its maximum. The ramp portion extends along a first part of the slot 37. After this part, the slot edges may be flat and parallel with the attenuation and retraction device lid.

Figure 4A:
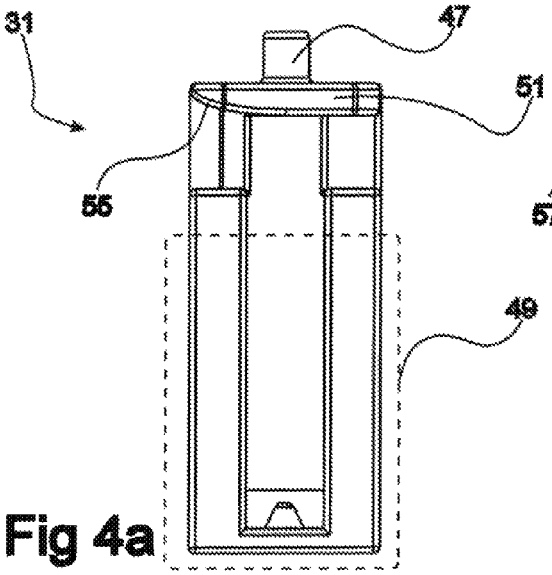
FIGS. 4*a* and 4*b* shows a pin for interaction with an attenuation and retraction device.
Figure 4B:
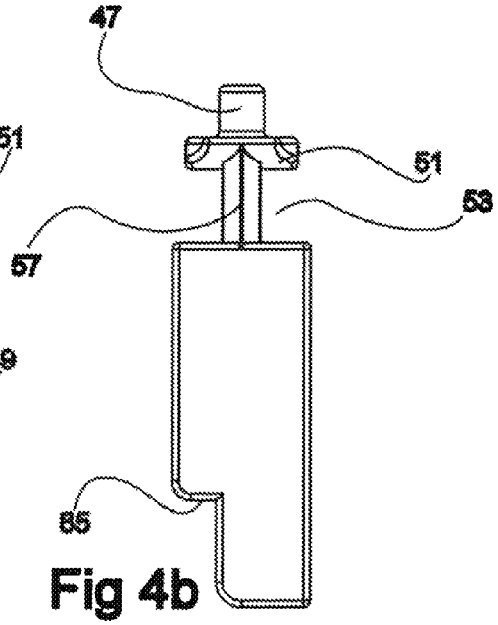

A pin 31 that is devised to interact with an attenuation and retraction device of this kind is illustrated in FIGS. 4*a* and 4*b*. FIG. 4*a* shows a side view, i.e. as seen perpendicularly to the direction of travel of a door, and FIG. 4*b* shows a front view, as seen from the attenuation and retraction device.

The pin 31 has a tip 47 that is intended to connect to the features in the interior of the attenuation and retraction device that provides the braking/closing function, such as described in EP-2372054-A1.

The portion 49 at the opposite end of the pin as seen from the tip 47 is arranged to be slideably fitted to the door, typically to a wheel cassette that is attached to the door. This may be arranged by providing an opening in the cassette that has a similar cross section as the corresponding portion of the pin 31. As will be described, a stop that prevents the pin from leaving the door, and a spring that pulls the pin 31 to an innermost position may be provided.

The pin 31 further has a wing portion 51 that is adapted to interact with the ramp portion 41 of the attenuation and retraction device lid 35. The portion below the wing portion 51 may be defined as a waist portion 53. The width of the wing portion 51 is wider than the width of slot 37 in the lid, but the width of the waist portion 53 is not. Therefore, the tips 45 (FIG. 2*b*) of the slot edges may enter into the waist portion 53 of the pin 31. As the pin 31 passes the ramp portion 41 the pin is pulled out of the door by the slot, such that the tip 47 of the pin 31 reaches further into the slot after passing the entry point 39. The ramp portion 37 of the slot thus positions the tip 47 of the pin 31 reliably inside the attenuation and retraction device to interact therewith.

To further improve the catching function, the pin 31 can be devised with a wing portion 51 where the wings, which extend laterally with regard to travelling direction of the door, have a tapered portion 55 at the edge that faces the attenuation and retraction device. The wings thus taper upwards, as illustrated in FIG. 4*a*, such that they more easily slip into the lid slot at the entry point. Alternatively, the edge of the wing that faces the attenuation and retraction device can be angled upwards. In both cases the surfaces of the pin that will be pulled by the slot edges are angled to be more exposed to the pulling surfaces under the slot edges. In principle, the wings may be angled in this way as a whole, and may interact with slot edges that are straight, without a ramp portion, as a ramp is then instead provided on the pin. This requires that the slot edges extend far enough from the base of the attenuation and retraction device to catch the front end of the wings.

Additionally, the front end 57 of the pin 31 at the waist portion can be tapering in the direction facing the attenuation and retraction device, such that the waist portion is more easily fitted in between the slot edges.

It should be noted that a ramp portion could be devised differently. For instance, the slot of the lid could be flat, and a ramp portion could be devised e.g. at one side of the slot, interacting with a portion protruding from the pin laterally with regard to the slot. This would also provide a catching function on the lid. Another way to accomplish a catching function could be to use a magnet in the attenuation and retraction device attracting a ferromagnetic pin, or vice versa.

Figure 5B:
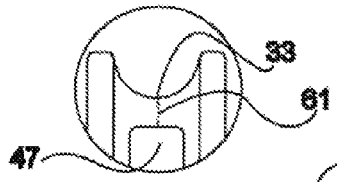
FIG. 5*b* shows an enlarged portion of FIG. 5*a;*
Figure 5A:
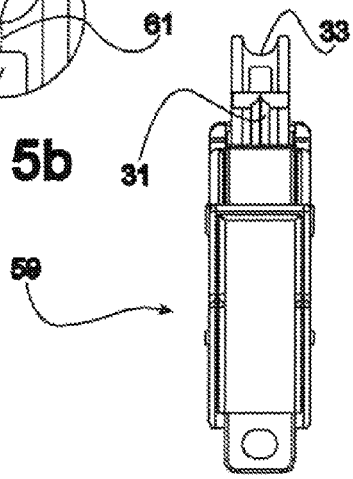
FIG. 5*a* shows a front view of a wheel cassette.
Figure 6B:
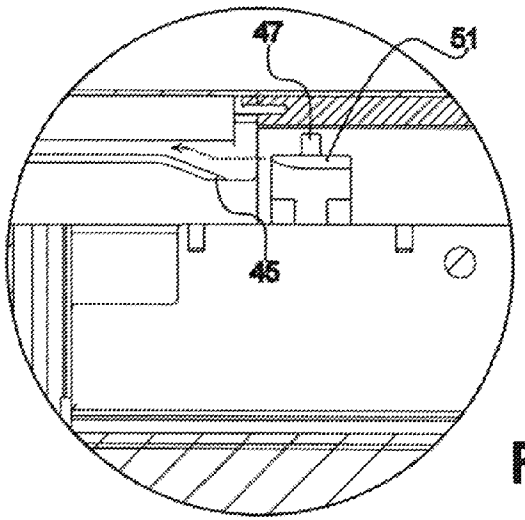
FIG. 6*b* shows an enlarged portion of the door of FIG. 6*a;*
Figure 7:
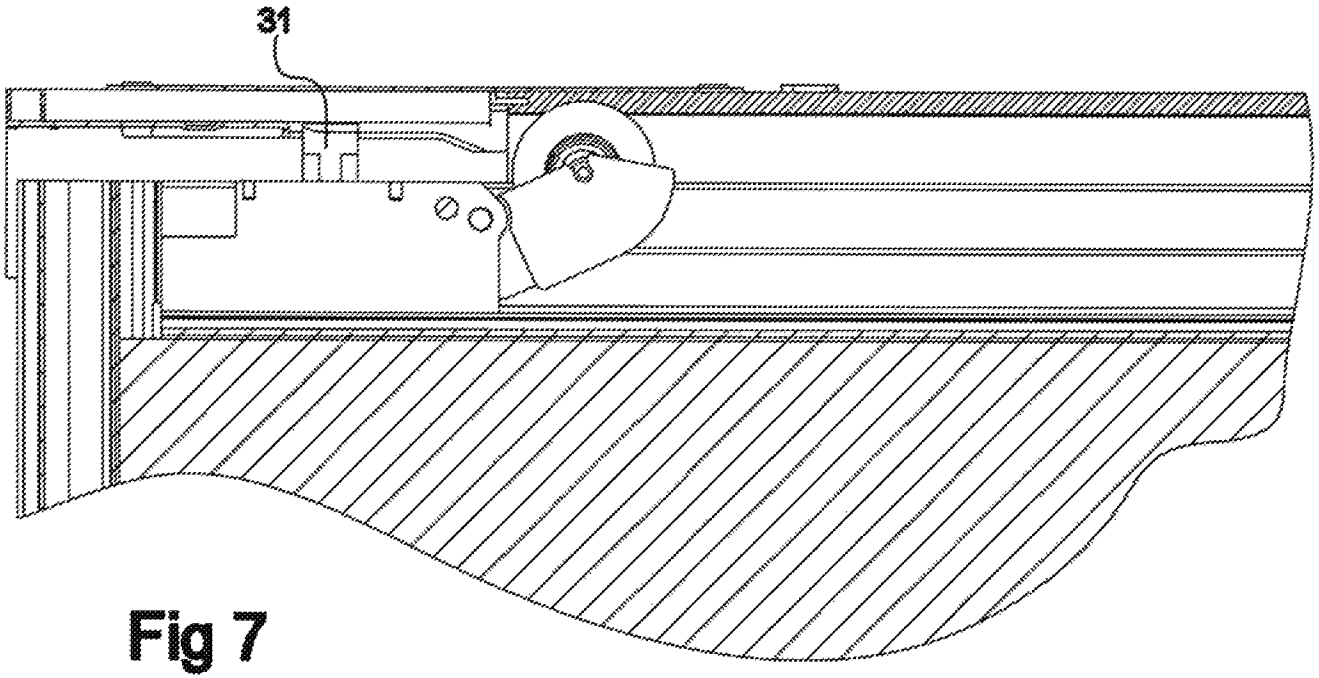
FIG. 7 shows a cross section of the door in FIG. 3 in a second position.

FIG. 5*a* shows a front view of a wheel cassette 59 for a door. The cassette which will be described in greater detail later includes the wheel 33 which may be spring loaded and the pin 31. The cassette may be produced as a component that can be fitted to different varieties of doors, e.g. different door material, sizes etc. However, it would also be conceivable to include the corresponding components directly in the door.

FIG. 5*b* shows an enlarged portion of FIG. 5*a*. As is shown, there is provided a gap 61 between the wheel 33, where the wheel is intended to be supported by the rail, and the tip 47 of the pin 31. This is provided by a steering function as will be described later. Typically, the gap 61 is intended to be 2±0.5 mm, although different sizes are conceivable. Thanks to this gap, the pin does not wear against the rail.

Figure 6A:
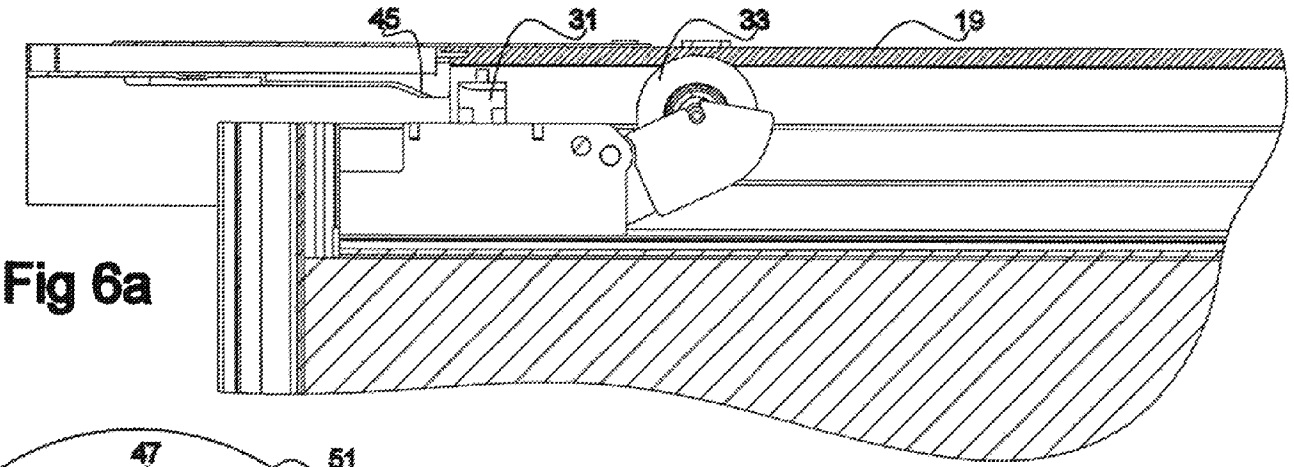
FIG. 6*a* shows a cross section of the door in FIG. 3 in a first position.

The gap is also shown in FIG. 6*a*, which shows a cross section of a door before reaching a position where the attenuation and retraction device becomes activated. The door, the rail, and the attenuation and retraction device are shown in cross-section while the wheel cassette with included components are not shown in cross section.

As is shown, the wheel 33 is urged against the rail, and the pin 31 is in a relatively retracted position. As is more clearly shown in the enlarged FIG. 6*b*, the wing portion 51 of the pin is located above the tip of the ramp 45. Thereby, the wing portion 51 will follow the trajectory illustrated with a dotted arrow in FIG. 6*b* when reaching the ramp portion, pulling the pin 31 further out of the cassette. This positions the tip 47 of the pin 31 reliably inside the attenuation and retraction device. The attenuation and retraction device begins to interact with the pin, and the arrangement finally reaches the position shown in FIG. 7 where the door is shut. Note that the pin is now in a relatively extended position as compared with FIG. 6*a*.

Figure 8:
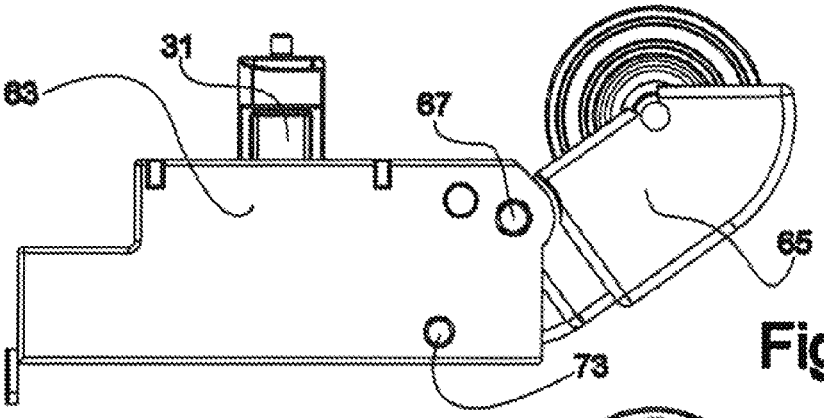
FIG. 8 is side view of a first side of a wheel cassette with the wheel first position.
Figure 9:
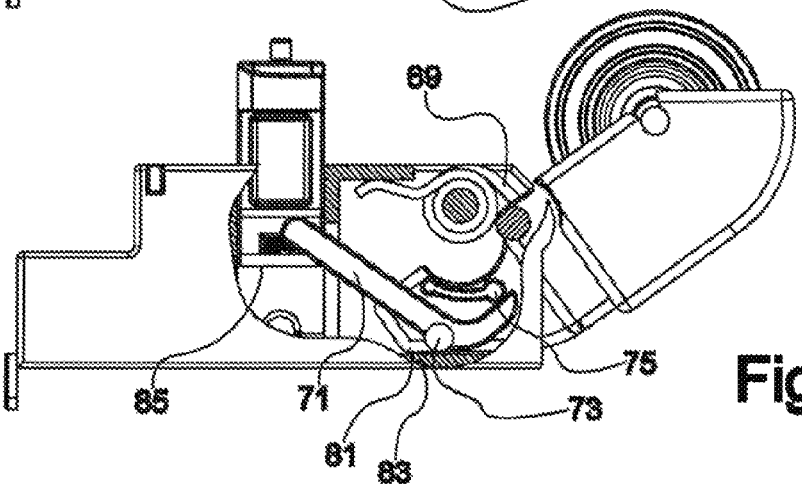
FIG. 9 is a partial cutaway side view of the wheel cassette of FIG. 8 with the wheel in the first position.

FIGS. 8-14 present functionalities in a wheel cassette 63. The cassette 63 may be built as a generally flat box, which provides features allowing the cassette to be mounted, on the door, and supports the included components. The cassette has a wheel holder 65 which extends out of the interior of the cassette 63 as shown in FIG. 8. The wheel holder 65 is pivotably attached to the cassette 63 at a wheel holder pivot 67 axis, where it is suspended between the side walls of the cassette 63. A torsional spring 69 urges the wheel holder 65, counter-clockwise as shown in FIG. 9, towards its most extended position, thereby urging the wheel 33 towards the rail, that would be placed above the cassette shown in FIG. 9. FIG. 9 shows the position where the wheel is most extended, an inner portion 81, at the opposite side of the pivot 67 as seen from the wheel, resting against the cassette floor 83.

Figure 14:
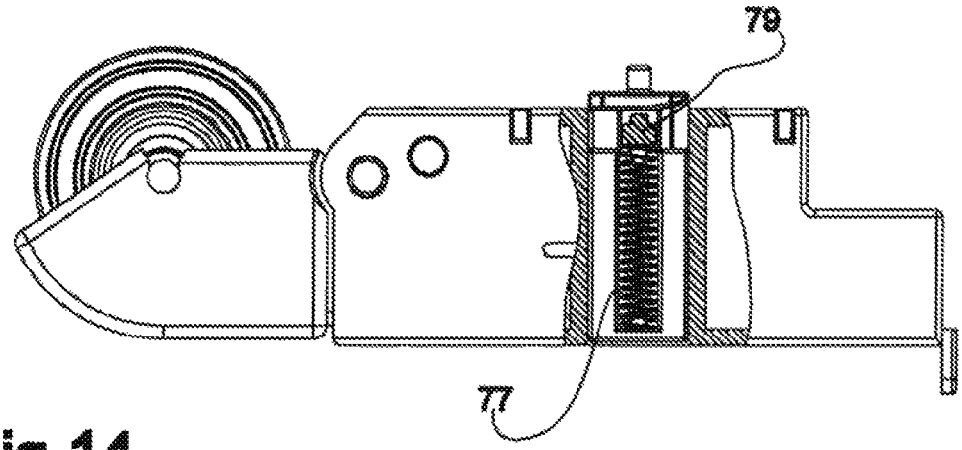
FIG. 14 is partial cutaway side view of the second side of the wheel cassette of FIG. 8 with the wheel in the third position.

As is shown in the cut-out in FIG. 14, a compression spring 77 urges the pin 31 inwards, towards the interior of the cassette. In FIG. 9 however, the force of the spring (located behind the pin in the view in FIG. 9) is overcome by a transmission mechanism, which includes an abutment 75 on the wheel holder 65, displaced from the wheel holder pivot 67, and a pivoting transmission lever 71, which is pivotably attached to the cassette 63 at a pivot axis 73. The abutment 75 in FIG. 9 abuts one side of the transmission lever 71 causing the arm to pivot clockwise when the wheel holder turns counter-clockwise. The other end of the lever, which is connected to the pin 31 by resting on an abutment surface 85 (FIG. 4*b*), thereby forces the pin outwards. By means of this function, the pin 31 is urged, against the force of the compression spring 77, out of its retracted position, such that it is positioned close to the rail, but not in contact with the same. Thereby, the pin is well positioned to interact with the attenuation and retraction device. When this happens, the catching function in the attenuation and retraction device pulls the pin out further, thereby further compressing the spring 77. Although a constant gap between the wheel and the pin tip, in the direction towards the rail, would be advantageous, some deviations during the extending of the wheel can be allowed. When the attenuation and retraction device pulls the pin further out, this gap is eliminated, but at that point, the pin does not face the rail.

Other ways of accomplishing the transmission function are conceivable, e.g. providing the abutment 75 as a cam surface, using cogwheels, etc.

Figure 10:
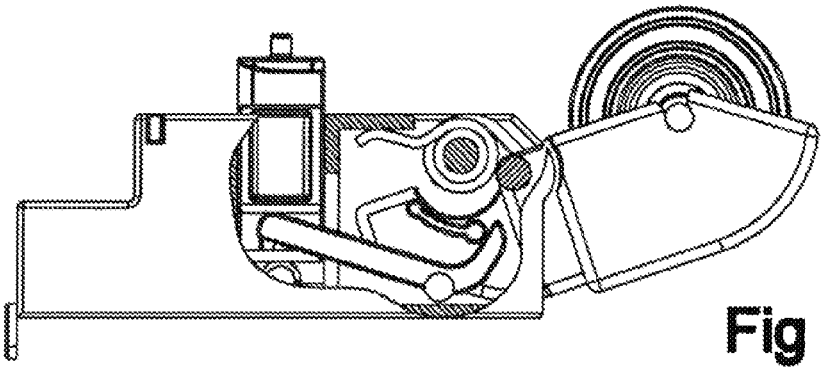
FIG. 10 is a partial cutaway side view of the wheel cassette of FIG. 8 with the wheel in a second position.
Figure 11:
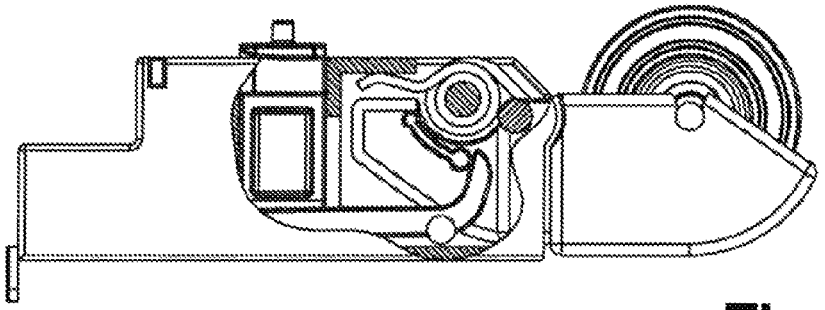
FIG. 11 is a partial cutaway side view of the wheel cassette of FIG. 8 with the wheel in a third position.

FIGS. 9-11 show how the transmission mechanism makes the pin follow the wheel downwards. The more the wheel is pivoted away from the extended position, the further the pin is retracted by the influence of the compression spring.

Figure 12:
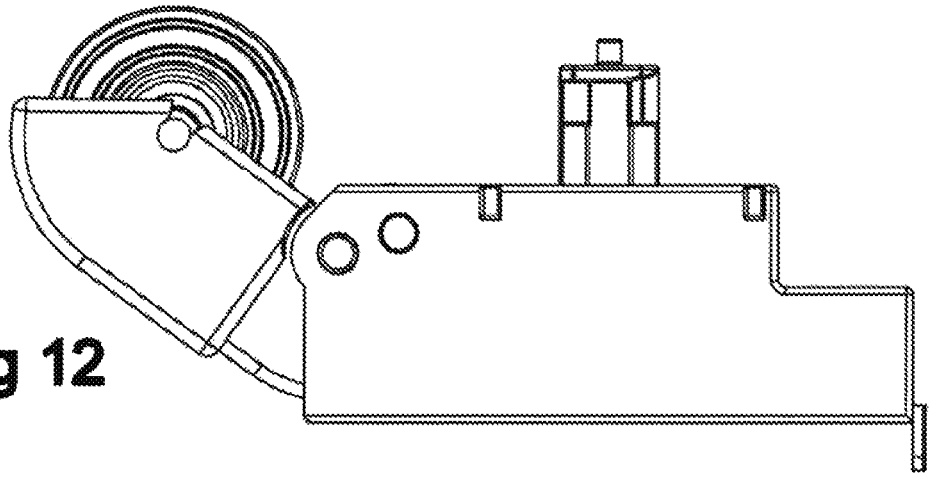
FIG. 12 is side view of a second side of a wheel cassette of FIG. 8 with the wheel in a first position.
Figure 13:
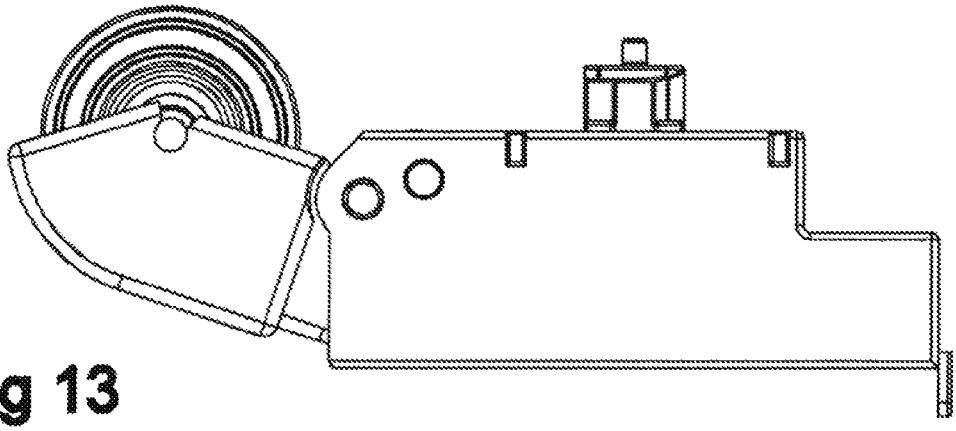
FIG. 13 is side view of the second side of the wheel cassette of FIG. 8 with the wheel in the second position.

FIGS. 12-14 show corresponding positions as FIGS. 9-11 but seen from the other side of the wheel cassette. In FIG. 14, a cut-out exposes the pin 31 and the compression spring 77. The compression spring 77 is located in a recess in the pin and between the floor of the recess and a stop 79 that extend from the cassette side wall and into the recess, This stop further prevents the pin 31 from leaving the cassette.

The present disclosure is not restricted to the above described examples and may be altered and varied in different ways within the scope of the appended claims. For instance, while the above embodiments show a top-wheel arrangement, where the wheel runs on a rail above the door and is urged against this rail by a torsional spring, bottom wheel arrangements are also possible. If so, the torsional spring is replaced by an adjustment mechanism that e.g. by means of a screw allows the end user to adjust the extent of the wheel extension of the door, e.g. in the way illustrated in aforementioned EP-2372064-A1. A transmission mechanism as illustrated above may nevertheless be provided to ensure that the pin is adjusted corresponding to the adjustment of the wheel.

The above illustrated function where the position of the pin is adjusted in accordance with the adjustment of the wheel may also be used together with attenuation and retraction devices that do not have a special catching function to pull the pin out. For instance, by providing a slightly raised attenuation and retraction device where the functions intended to interact with the tip of the pin are located slightly higher than the point where the rail ends, reliable interaction can be ensured with an accurate positioning of the pin tip close to the rail.

Although a system with two rail tracks, and correspondingly an attenuation and retraction device with two slots are shown above, more or less tracks could be used. Instead of a compression spring as shown in FIG. 14, the pin's own weight could be used to pull the pin back into the door.

Although the invention has been described with reference to specific embodiments, these descriptions are not meant to be construed in a limiting sense. Various modifications of the disclosed embodiments, as well as alternative embodiments of the invention, will become apparent to persons skilled in the art upon reference to the description of the invention. It should be appreciated by those skilled in the art that the conception and the specific embodiment disclosed might be readily utilized as a basis for modifying or designing other structures for carrying out the same purposes of the present invention. It should also be realized by those skilled in the art that such equivalent constructions do not depart from the spirit and scope of the invention as set forth in the appended claims.

It is therefore contemplated that the claims will cover any such modifications or embodiments that fall within the true scope of the invention.

What is claimed is:

1. A sliding door arrangement comprising:

at least one sliding door;

a rail system including at least one rail for guiding a sliding motion of the door;

an attenuation and retraction device adapted to be received in an extension of the rail for braking the sliding motion of the door at a brake position proximate a door end position and for retracting the door to the door end position, the attenuation and retraction device including a lid with a slot open towards the rail at an entry point and a catching device; and a pin slidably attached to the door and adapted to slide between a pin retracted position and a pin extended position and to be received by the slot of the attenuation and retraction device when reaching the entry point, wherein the catching device of the attenuation and retraction device is adapted to pull the pin in a direction out of the door toward the pin extended position and into the slot after the pin passes the entry point and as the door approaches the door end position.

2. The sliding door arrangement of claim 1, wherein the catching device comprises a ramp device in the lid of the attenuation and retraction device.

3. The sliding door arrangement of claim 2, wherein the slot is defined between two longitudinal edges that extend a length of the slot and retain the pin as it enters the slot, and wherein the ramp device comprises a portion of the slot near the entry point angled away from a top surface of the lid and toward the rail.

4. The sliding door arrangement of claim 3, wherein the pin comprises:

a tip for interacting with the attenuation and retraction device;

a wing portion having a width greater than a width of the slot of the attenuation and retraction device; and a waist portion spaced from the tip by the wing portion and having a width less than the width of the slot of the attenuation and retraction device such that the wing portion can enter beneath the slot after passing the entry point towards the door end position.

5. The sliding door arrangement of claim 4 wherein the wing portion includes a tapering portion tapering towards the attenuation and retraction device.

6. The sliding door arrangement of any one of claim 1, 4, or 5, further comprising a spring for urging the pin towards the pin retracted position.

7. The sliding door arrangement of any one of claim 1, 2, 3, 4, or 5, wherein the door further comprises a transmission mechanism and a wheel carried by a wheel holder for moving the wheel between a wheel retracted position and a wheel extended position, the transmission mechanism interconnecting the wheel holder and the pin for moving the wheel towards the wheel extended position to urge the pin towards the pin extended position.

8. The sliding door arrangement of claim 7, further comprising a spring for urging the pin towards the pin retracted position.

9. The sliding door of claim 7, wherein the wheel holder comprises a spring for urging the wheel towards the wheel extended position and against the rail.

10. The sliding door of claim 7, wherein the transmission mechanism is operable to maintain a gap between a tip of the pin and the rail.

11. The sliding door of claim 7, wherein the wheel holder and the pin are mounted in a cassette.

* * * * *